US009833815B2

(12) United States Patent
Gruna et al.

(10) Patent No.: US 9,833,815 B2
(45) Date of Patent: Dec. 5, 2017

(54) CONVEYING SYSTEM, PLANT FOR SORTING BULK GOODS HAVING A CONVEYING SYSTEM OF THIS TYPE, AND TRANSPORT METHOD

(71) Applicant: FRAUNHOFER-GESELLSCHAFT ZUR FÖRDERUNG DER ANGEWANDTEN FORSCHUNG E.V., Munich (DE)

(72) Inventors: Robin Gruna, Baden-Baden (DE); Kai-Uwe Vieth, Karlsruhe (DE); Henning Schulte, Coburg (DE); Thomas Langle, Eggenstein (DE); Uwe Hanebeck, Waldbronn (DE); Marcus Baum, Gottingen (DE); Benjamin Noack, Karlsruhe (DE)

(73) Assignee: FRAUNHOFER-GESELLSCHAFT ZUR FÖRDERUNG DER ANGEWANDTEN FORSCHUNG E.V. (DE)

( * ) Notice: Subject to any disclaimer, the term of this patent is extended or adjusted under 35 U.S.C. 154(b) by 0 days.

(21) Appl. No.: 15/119,019

(22) PCT Filed: Feb. 9, 2015

(86) PCT No.: PCT/EP2015/052587
§ 371 (c)(1),
(2) Date: Aug. 15, 2016

(87) PCT Pub. No.: WO2015/128174
PCT Pub. Date: Sep. 3, 2015

(65) Prior Publication Data

US 2016/0354809 A1 Dec. 8, 2016

(30) Foreign Application Priority Data

Feb. 28, 2014 (DE) ..... 10 2014 203 638
Apr. 15, 2014 (DE) ..... 10 2014 207 157

(51) Int. Cl.
*B07C 5/00* (2006.01)
*B07C 5/342* (2006.01)
(Continued)

(52) U.S. Cl.
CPC ..... *B07C 5/361* (2013.01); *B07C 5/10* (2013.01); *B07C 5/342* (2013.01); *B07C 5/3425* (2013.01); *B07C 2501/0018* (2013.01)

(58) Field of Classification Search
CPC ..... B07C 5/361; B07C 5/342; B07C 5/02; B07C 5/10; B07C 5/3422; B07C 5/3425;
(Continued)

(56) References Cited

U.S. PATENT DOCUMENTS 5,779,058 A * 7/1998 Satake ..... B07C 5/3425 209/581
6,380,503 B1 * 4/2002 Mills ..... B07C 5/10 209/579

FOREIGN PATENT DOCUMENTS

EP 0719598 A2 7/1996
WO 97/46328 A1 12/1997

OTHER PUBLICATIONS

International Search Report issued in PCT/EP2015/052587 dated Apr. 28, 2015, 6 pages.
(Continued)

*Primary Examiner* — Mark Beauchaine
(74) *Attorney, Agent, or Firm* — Gesmer Updegrove LLP

(57) ABSTRACT

Conveying system for transporting a material flow (M) comprising a large number of individual objects (O1, O2, . . . ), characterized in that with the conveying system, by means of optical detection of individual objects (O1, O2, . . . ) in the material flow (M), for these objects (O1, O2, . . . ) respectively the location position (x(t),y(t)) thereof at several different times ($t_{-4}$, $t_{-3}$, . . . ) can be determined
(Continued)

Figure 1:
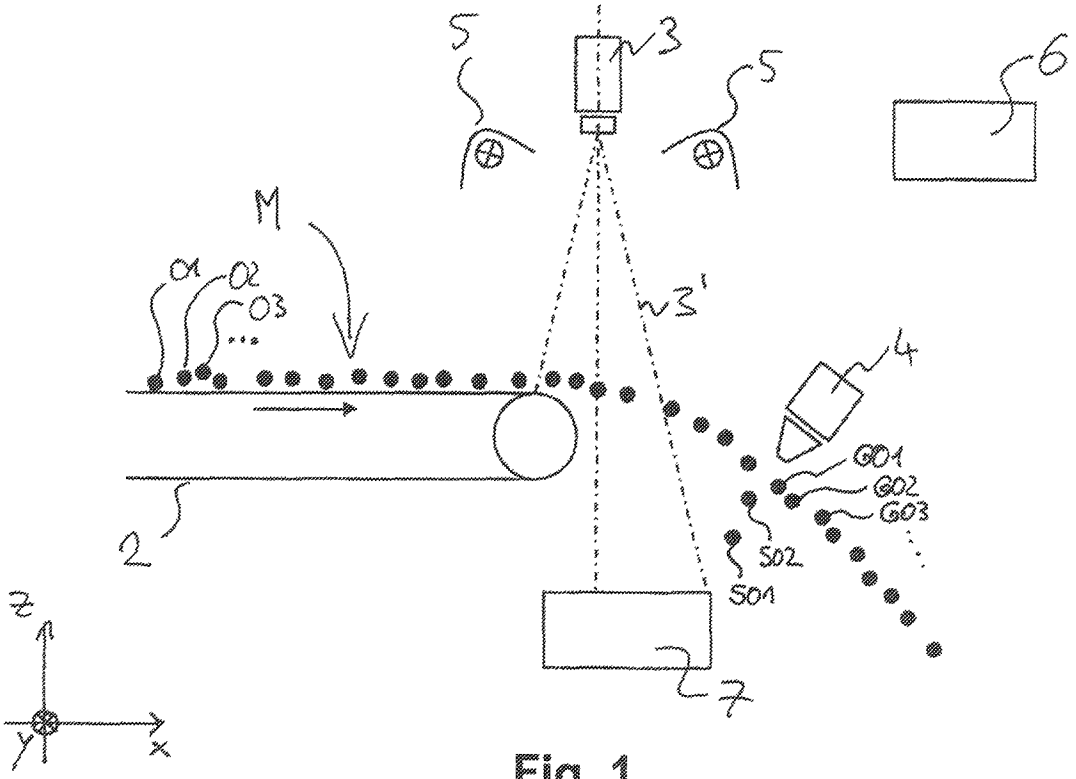

and by means of the location positions (x(t),y(t)) for these objects (O1, O2, . . . ) determined at the different times ($t_{-4}$, $t_{-3}$, . . . ), respectively the location ($x_b(t_b)$,$y_b(t_b)$) thereof at at least one defined time ($t_b$) after the respectively latest of the different times ($t_{-4}$, $t_{-3}$, . . . ) can be calculated.

15 Claims, 6 Drawing Sheets

(51) Int. Cl.
*B07C 5/36* (2006.01)
*B07C 5/10* (2006.01)

(58) Field of Classification Search
CPC . B07C 5/363; B07C 2501/0018; B65G 43/08; B65G 47/42
See application file for complete search history.

(56) References Cited

OTHER PUBLICATIONS

Written Opinion issued in PCT/EP2015/052587, dated Feb. 28, 2014 (4 pages).

* cited by examiner

CONVEYING SYSTEM, PLANT FOR SORTING BULK GOODS HAVING A CONVEYING SYSTEM OF THIS TYPE, AND TRANSPORT METHOD

PRIORITY INFORMATION

This application is a 371 of PCT Application No. PCT/EP2015/052587 filed Feb. 9, 2015, which claims the benefit of German Application No. 10 2014 203 638.0 filed Feb. 28, 2014, and German Application No. 10 2014 207 157.7 filed Apr. 15, 2014, their contents and substance of which are herein incorporated by reference.

Automatic bulk material sorting makes it possible, with the help of digital image production and image processing, to separate bulk materials into separate fractions (for example good and bad fraction) by means of optically detectable features, with a high throughput. For example, belt sorting systems which use linear, image-providing sensors (e.g. line cameras) for image production are known. Image production by the line sensor is thereby effected on the conveyor belt or in front of a problem-adapted background and synchronously to the belt movement. Material ejection of a fraction (i.e. the bad fraction or the bad objects) is generally effected by a pneumatic blow-out unit or by a mechanical ejection device (cf. e.g. H. Demmer "Optische Sortieranlagen" (Optical Sorting Plants), BHM vol. 12, Springer, 2003). As an alternative to a conveyor belt, the material transport can also be effected via free fall or in a controlled air flow.

Because of constructional restrictions and also the computing time required for image evaluation in a computer, the observation time of an object to be ejected, which is subsequently termed $t_0$, cannot correspond with the ejection- or blow-out time. The blow-out unit is therefore spatially separated from the line of sight of the line camera. For correct ejection of a bad object, the blow-out time (which is subsequently termed $t_b$ or, since estimated, $\hat{t}_b$) and also the position of the object to be ejected (which is subsequently termed $x_b(t_b)$ or, since estimated, $\hat{x}_b$)) must therefore be estimated. The bold "x" hereby denotes that it generally concerns a multidimensional location position, also the term $\hat{x}$ being used subsequently for this purpose as an alternative. In the case of the estimations implemented in the state of the art, it is however assumed that the object to be blown out has no intrinsic movement relative to the belt and hence moves at the speed vector $v_{belt}$ of the conveyor belt. The ejection time $t_b$ and the ejection location $x_b(t_b)$ are then estimated by a linear prediction based on the speed vector of the conveyor belt $v_{belt}$ and of the measured object position $x(t_0)$ at the observation time $t_0$.

Many bulk materials have however proved to be uncooperative because of the geometry and the weight thereof and display, relative to the transport belt, an additional intrinsic movement (for example peas, pepper, round granulates). In addition, because of a variable air resistance (also the weight or the density can play a role here) of the individual objects, the result can be an influence on the trajectory. As a result, the assumption of a constant linear movement of the bulk material in accordance with $v_{belt}$ is invalidated and the object position $x_b(t_b)$ at the estimated blow-out time $t_b$ is predicted wrongly. As a consequence thereof, no ejection of the detected bad objects or of the bad fraction takes place and in addition good material is possibly ejected in error. For uncooperative bulk materials, often no optical sorting with the optical sorting systems known according to the state of the art based on line sensors is therefore possible.

In order to circumvent this problem, special systems for sorting uncooperative materials are known from the state of the art (DE 10 2004 008 642 A1 and DE 69734198 T2), which systems operate however with high complexity for mechanical material settling (via mechanical means, an intrinsic movement of the bulk material on the conveyor belt is suppressed). However, these systems have a high technical production and maintenance cost (for example the use of specially profiled conveyor belts and vibration troughs).

Starting from the state of the art, it is therefore the object of the present system to make available a conveying system for transporting a material flow comprising a large number of individual objects (and also a plant, based thereon, for bulk material sorting) and a corresponding transport method, with which a highly-precise prediction about the location position of even uncooperative bulk material objects, and hence optimised automatic bulk material sorting is made possible even for such objects.

This object is achieved by a conveying system according to claim 1, by a plant for bulk material sorting according to claim 13 and also by a transport method according to claim 15. Advantageous embodiment variants can thereby be deduced respectively from the dependent patent claims.

Subsequently, the invention is firstly described in general, then in detail with reference to embodiments. The individual features of the invention, which are shown in combination with each other in the embodiments, need not thereby be produced precisely in the illustrated combinations. In particular, some of the illustrated features of the embodiments can also be omitted or, according to the structure of the dependent claims, be combined with further features of the invention even in a different way. In fact some of the illustrated features can represent per se an improvement to the state of the art.

A conveying system according to the invention is described in claim 1.

For different objects, the position thereof can also be determined at different times. Generally, the same times at which respectively the location positions thereof are determined are however chosen for all objects (the times are fixed for example via the time of the recording of camera images of an optical detection unit of the system). For different objects, the defined times, for which respectively the location of the respective object is calculated (by means of which location positions determined already and associated with this object) can be different. The respective location can however also be calculable or predictable for all detected objects for one and the same later time. According to the invention, a prediction is therefore made possible in order to estimate, with great precision, the location position of any detected object at a time in the future—regarded from the time of the last location position determination of this object.

On the basis of image processing methods, known per se to the person skilled in the art (thus a recorded camera image of the objects can be subjected to an image pre-processing, such as for example an edge detection, and subsequently segmentation can be implemented), in image recordings (generally digital), produced in the optical detection, of the material flow or of the objects located therein, the individual objects can thereby be identified and differentiated from each other in order to determine the location positions of a defined object at the various times and in order to track the path of this object herewith (object tracking). On the basis of the identification and differentiation of the individual objects in an optically detected image series, a movement path for the object can be determined for each object from the location positions of this object determined at different times. For example by means of this movement path, the future location can be estimated or calculated (possibly on the basis of a movement model for the currently observed object which is determined or selected with the movement path or the individual object positions at different times).

Hence, the individual objects in the material flow can be identified according to the invention and, by means of the position of an object determined multiple times at different times, the location thereof can be determined, with great precision, at a time in the near future (i.e. for example shortly after leaving the conveyor belt at the level of the blow-out unit). For transporting the material flow, the conveying system according to the invention can have a conveying unit which can concern a conveyor belt. Likewise, the invention can be used in the case of conveying systems which operate on the basis of free fall or of a controlled air flow.

Claim 2 shows the first advantageously achievable features of the invention.

Determining such movement paths, in the scope of the invention, is subsequently also termed object tracking. Determining the movement paths is thereby effected preferably with the assistance of a computer in a computer system of the conveying system i.e. microprocessor-based.

Claim 3 describes further advantageously achievable features.

A movement model selected for an object can thereby serve for modelling future object movements of this object. The movement models can be stored in a data bank in the memory of the computer system of the conveying system. Such a movement model can comprise movement equations, the parameters of which can be determined by regression methods (for example method of least squares, least-squares-fit) or by a Kalman filter expanded by a parameter identification by means of the determined location positions or of the determined movement path of the respective object. It is thereby possible to select the movement model only after the presence of all location positions of an object which have been recorded and determined during the optical detection. As an alternative thereto, the movement model can be selected or exchanged in real time, even during recording of the individual images for the successive determination of the individual location positions (i.e. whilst the individual image recordings are still being implemented, possibly changing over to a different movement model for the already observed object can be effected if, for example, a fit method shows that this other movement model reproduces the movement course of the object more precisely).

Claim 4 describes further advantageously achievable features.

Classification need not thereby be effected on the basis of or using the location positions determined during the optical detection (in particular: from the successive camera recordings) (even if the information about the determined location positions can have an influence advantageously on the classification, see also subsequently). Thus classification of an object identified by means of its location positions at different times or of its movement path can also be effected purely by means of geometric features (e.g. outline or shape) of this object, the geometric features being able to be determined via suitable image processing methods (e.g. image pre-processing, such as edge detection, with subsequent segmentation) from the images obtained during the optical detection.

Classification can be effected in particular into precisely two classes, one class of good objects and one class of bad objects (which are to be ejected). Classification can hence take place using images of the objects recorded during the optical detection by these images being evaluated with suitable image processing methods and thus for example object shape, object position and/or object orientation being determined at different times.

Subsequently, the combination of the location position thereof (or the position of its centre of gravity) and the orientation thereof is subsequently understood by the pose or spatial situation of an object. This can thereby concern a two-dimensional situation (e.g. relative to the plane of a conveyor belt of the conveying system—the coordinate perpendicular thereto is then not taken into account) but also a three-dimensional situation, i.e. the location position and the orientation of the three-dimensional object in space.

Further advantageously achievable features according to the invention can be deduced from claims 5 and 6.

The determined two-dimensional location position preferably concerns the position in the plane of a moveable conveyor belt, however relative to the immoveable elements of the conveying system: hence a position determination can be effected in the immoveable world coordinate system in which not only the immoveable elements of the conveying system are based but also, e.g. the optical detection device (camera).

Further advantageously achievable features are described in claim 7.

It is hence possible to determine, for the individual objects to be detected respectively, not only the location position but in addition also the orientation thereof in space (and/or the shape thereof), in total therefore the pose thereof at several different times. Also this thus determined orientation information can be used for calculating the locations at the defined time(s) after the respectively latest of the different times.

There is thereby no need, in addition to determining these locations, also to determine the orientation of the objects at the defined time(s) after the respectively latest of the different times. According to claim 8, this is however possible.

The determined orientations (in addition to the determined location positions) can influence also the determination of the movement paths.

Also determining the movement model/s and/or classifying the objects can be effected with the additional use of the determined orientation information.

Further advantageously achievable features are described in claim 9.

The surface sensor(s) can also be in particular (a) camera(s). For preference, CCD cameras can be used, also the use of CMOS sensors is possible.

Further advantageously achievable features are described in claim 8.

In the individual recorded images, respectively the shape of this/these object(s) can be determined via image processing measures (e.g. image pre-processing, such as e.g. edge detection with subsequent segmentation and subsequent object tracking algorithm). The three-dimensional image of an object can be generated by suitable algorithms (see e.g. R. Szeliski, Computer Vision: Algorithms and Applications, 1st edition, Springer, 2010; or A. Blake, M. Isard "Active Contours", Springer, 1998) from the shapes of an individual object, which are identified for example by object tracking in the individual images.

Further advantageously achievable features of the conveying system according to the invention can be deduced from claims 11 and 12. Advantageously achievable features of the plant according to the invention for bulk material sorting are found in claim 14.

Subsequently, the invention is described with reference to embodiments. There are shown:

FIG. 1 a basic construction, by way of example, of a plant according to the invention for bulk material sorting using a conveying system according to the invention.

Figure 2:
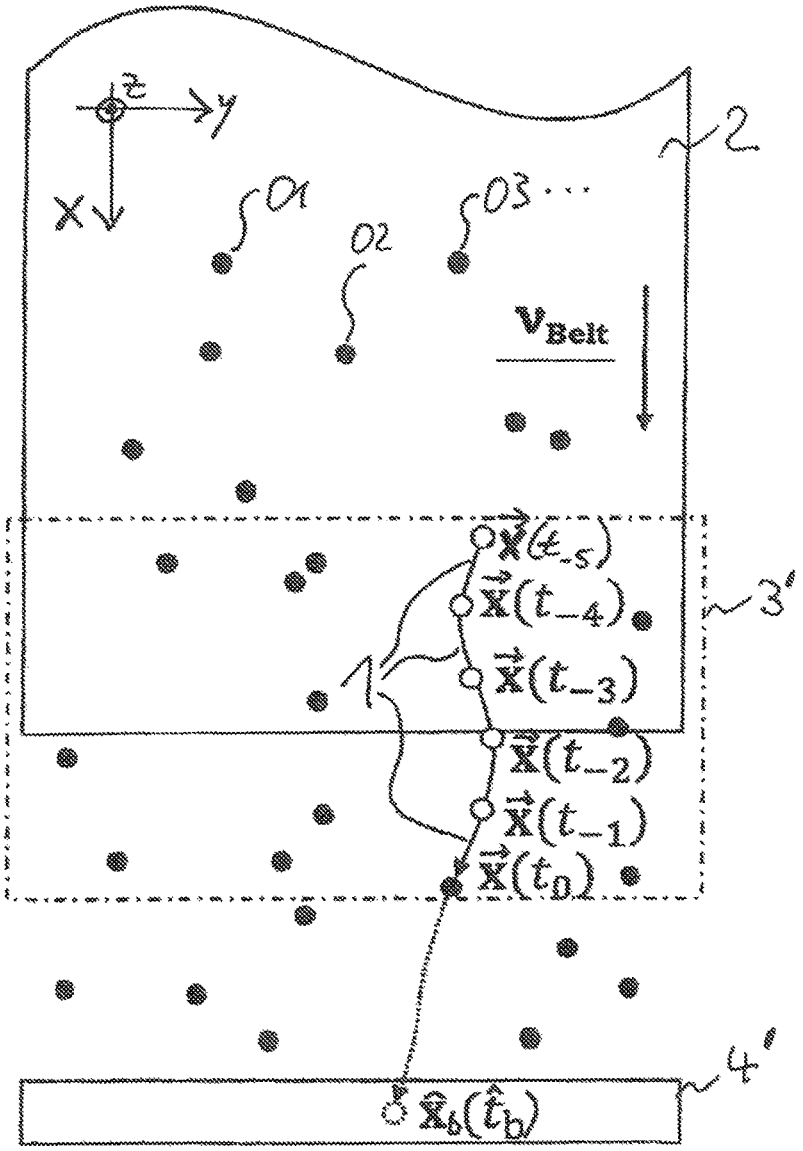
Figure 3:
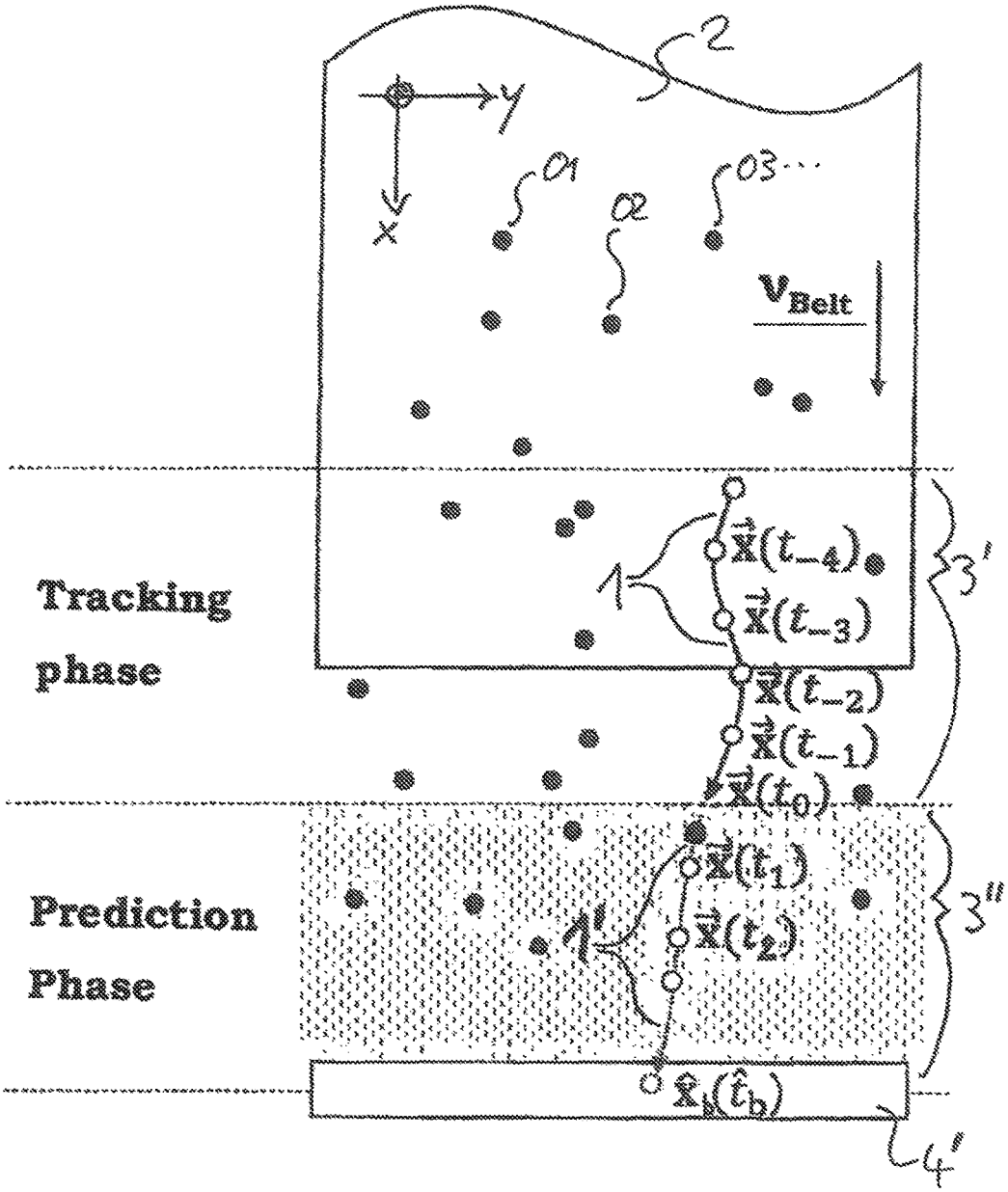
Figure 4:
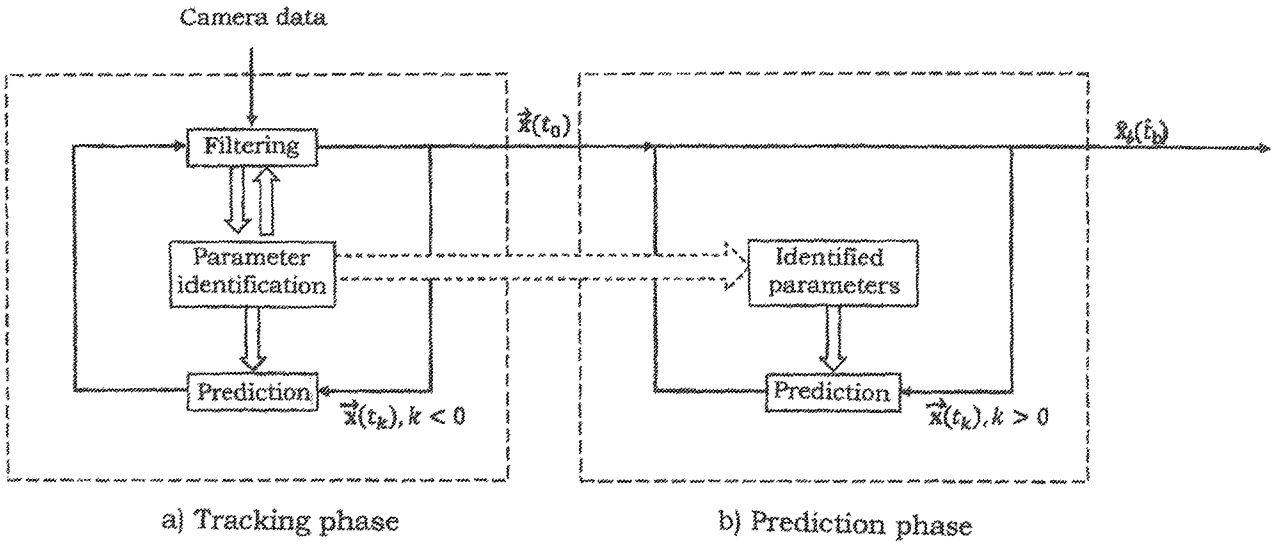

FIGS. 2 to 4 the mode of operation of the plant, shown in FIG. 1, for calculating the future location of objects of the material flow.

Figure 5:
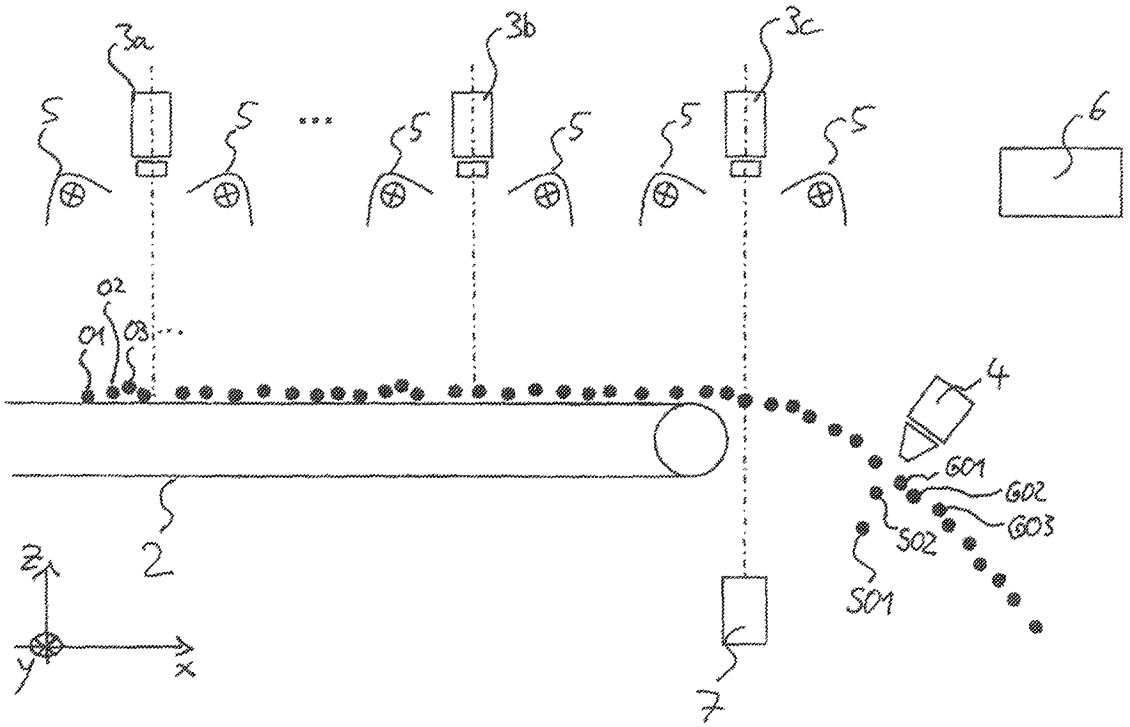

FIG. 5 the basic construction of a further plant according to the invention for bulk material sorting.

Figure 6:
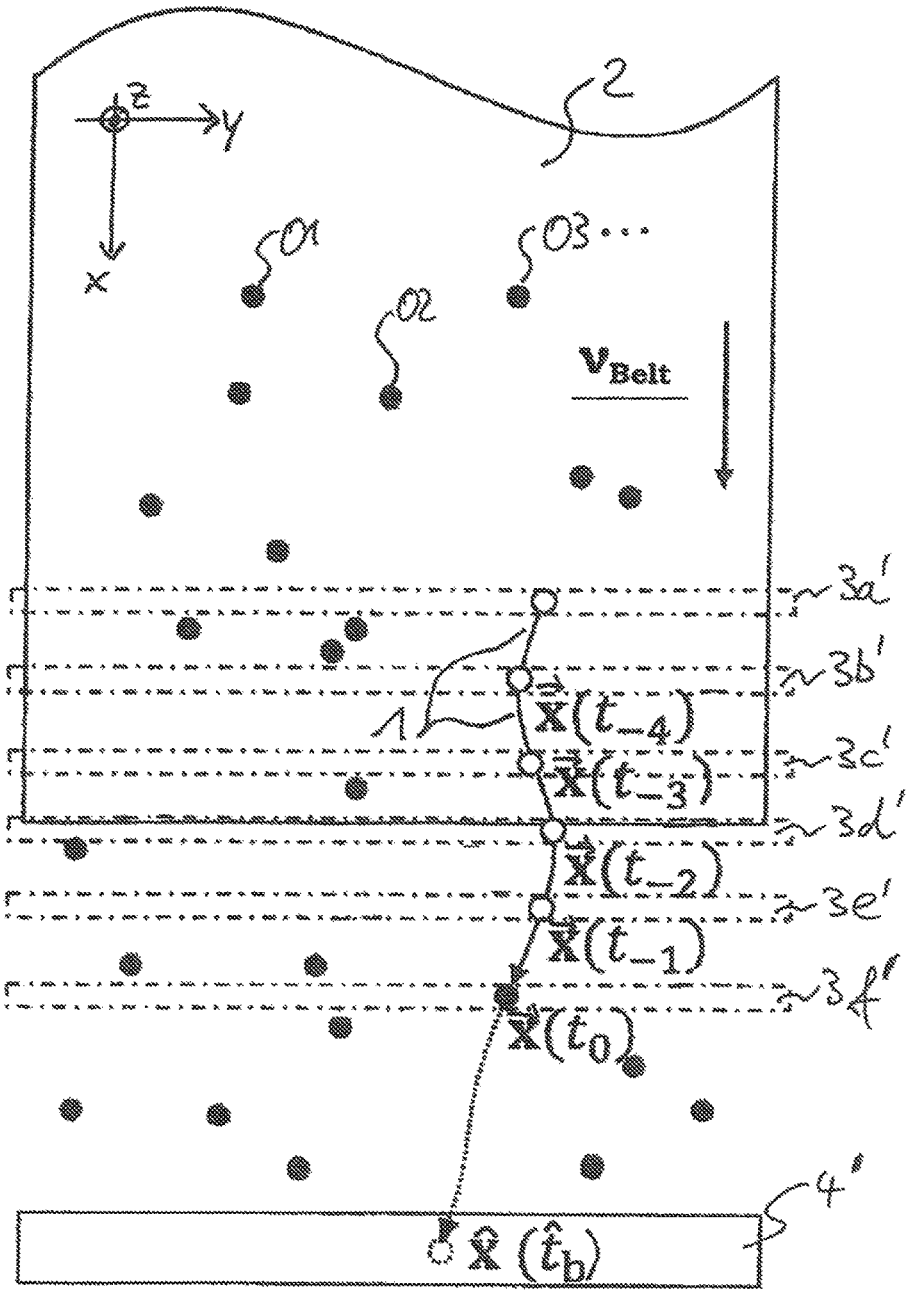

FIG. 6 the mode of operation of this plant.

The plant for bulk material sorting shown in FIG. 1 comprises a conveying system having a conveying unit 2 configured here as conveyor belt, a surface camera (CCD camera) 3 positioned above the unit 2 and at the ejection end of the same (and detecting the ejection end) and surface lighting means 5 for lighting the field of vision of the surface camera. The image production by the surface sensor (camera) 3 is hereby effected on the conveyor belt 2 or in front of a problem-adapted background 7 and is effected synchronously to the belt movement.

Furthermore, the plant comprises a sorting unit, only the blow-out unit 4 of which is illustrated here. In addition, a computer system 6 is shown, with which all of the subsequently described calculations of the plant or of the conveying system are implemented.

The individual objects O1, O2, O3 . . . in the material flow M are hence transported by means of the conveyor belt 2 through the detection region of the camera 3 and detected and evaluated there, with respect to the object positions thereof, by image evaluation algorithms in the computer system 6. Subsequently, separation is effected by the blow-out unit 4 into the bad fraction (bad objects SO1 and SO2) and into the good fraction (good objects GO1, GO2, GO3 . . . ).

According to the invention, a surface sensor (surface camera) 3 is hence used. The image production at the bulk material or material flow M (or the individual objects O1, . . . of the same) is effected by the camera 3 on the conveyor belt 2 and/or in front of a problem-adapted background 7. The image recording rate is adapted to the speed of the conveyor belt 2 or synchronised by a position transducer (not shown).

According to the invention, the aim is to produce an image sequence (instead of one momentary recording) of the bulk material flow at different times (in quick succession) by means of a plurality of surface scans or surface recordings of the material flow M by the surface camera 3, as follows (cf. FIGS. 2 to 4).

In FIG. 2, the field of vision 3' of the camera 3 onto the conveyor belt 2 with the bulk material or the objects O of the same is illustrated in plan view (FIG. 1 illustrates this field of vision 3' of the camera 3 in side view). The ejection is effected by the blow-out unit 4 (the blow-out region 4' of which is illustrated in FIG. 2 in plan view). As an alternative to the conveyor belt 2, the material transport could also be effected in free fall or in a controlled air flow (not shown here) if the units 3 to 7 are correspondingly repositioned.

Within the scope of the invention, the data production can hence be effected on the basis of one (or also a plurality) of image-providing surface sensors, such as the surface camera 3. This enables a position determination and also a measurement of physical properties of the individual particles or objects O1, . . . of the bulk material M at several different times, as is illustrated in FIG. 2. As image-providing surface sensors, also image-providing sensors outside the visible wavelength range and image-providing hyperspectral sensors can be used. In addition, the position determination can also be effected by one (or more) 3D sensor(s) which can provide the position measurement(s) of the individual objects in space instead of in the plane of the conveyor belt 2.

As FIGS. 2 to 4 show, a predictive multiobject tracking can be used in the present invention. By means of suitably high clocking of the camera, relative to $v_{belt}$ (i.e. the number of recorded camera images per unit of time) or the image production, the object positions x(t)=(x(t),y(t)) in the Cartesian coordinate system x, y, z (with the xy plane as plane in which the conveyor belt 2 is moved) can be measured at several different times t. Measurement of the object positions $x(t_{-5})$, $x(t_{-4})$, $x(t_{-3})$, . . . is effected at the different successive (generally successive at constant time intervals) times $t_{-5}$, $t_{-4}$, $t_{-3}$, . . . , $t_0$ characterising the last time of the observation of the object having the illustrated movement path 1 before this object leaves the field of vision 3' of the camera 3. From these different measured location positions at the different times, the result, for the individual optically detected objects (suitable detection algorithms of the image processing enable tracking of the individual objects (cf. here e.g. A. Yilmaz, O. Javed, and M. Shah, "Object tracking: A survey," ACM computing surveys (CSUR), vol. 38, no. 4, p. 13, 2006 or B. Jähne, Digitale Bildverarbeitung and Bildgewinnung (Digital Image Processing and Image Production), $7^{th}$ revised edition 2012, Springer, 2012), is respectively movement paths by lining up the individual detected and determined object positions x. This is shown in FIG. 2 with the movement path 1 for an individual object O for the movement thereof between the times $t_{-5}$ and $t_0$, between which this object has been detected in the detection region 3' of the camera 3 by individual image recordings. Hence, instead of an individual measurement $x(t_0)$ of the location of an object O1, O2, . . . , the observed movement path 1 with $x(t_0)$, $x(t_{-1})$, $x(t_{-2})$, $x(t_{-3})$, . . . of an object O1, O2, . . . is available for estimation or calculation of the location of this object at one (or also several) defined time(s) after the latest time $t_0$ at which the location position has been determined for this object in the series of recorded camera images. Hence, in particular for a later time $t_b$, at which this object is situated in the blow-out region 4' of the blow-out unit 4, the location can be estimated with great precision. With the blow-out position $x_b(t_b)$ calculated or estimated from the movement path 1, the blow-out unit 4 can remove this object (provided it concerns a bad object) specifically from the material flow M at the blow-out time $t_b$ on the basis of the blow-out position which is determined with great precision.

In addition, the predictive multiobject tracking method which is used provides in addition uncertainty data relating to the estimated dimensions in the form of a variance (blow-out time) or covariance matrix (blow-out position).

FIGS. 3 and 4 show more precisely the procedure which can be used according to the invention for the predictive multiobject tracking. Timewise, this procedure can be subdivided into two phases, a tracking phase and a prediction phase (the prediction phase being effected after the tracking phase considered timewise). FIG. 4 makes it clear that the tracking phase is composed of filter- and prediction steps and the prediction phase is restricted to prediction steps. As made clear in FIG. 3, the first phase (tracking phase) is assigned to the field of vision 3' of the surface camera 3. When a specific object from the quantity of objects O1, O2, . . . in the material flow M passes through this region 3', it can be identified in the individual camera images recorded at the times $t_{-5}$, $t_{-4}$, $t_{-3}$, . . . and a location position determination can be effected in real time. In addition to the determination of the location position, also a determination of the orientation of the object in the camera images can thereby be effected so that, in the first step according to the invention, respectively not only the location position but also the orientation of the objects is determined at several different times (i.e. the object pose), after which, in the second step according to the invention, respectively the location at at least one defined time (the blow-out time) after recording the last camera image can be calculated by means of the location poses for the individual objects determined at the different times.

FIG. 4 shows schematically this procedure of the predictive multiobject tracking. For the tracking of the objects in the tracking phase (FIG. 4*a*), recursive estimating methods can be used. Alternatively, also non-recursive estimating methods can however be used for the tracking. The recursive methods (e.g. Kalman filter methods) are composed of a sequence of filter- and prediction steps. As soon as an object is detected for the first time in the camera data, prediction- and filter steps follow. By means of the prediction, the current position estimation is extrapolated up to the next image recording (e.g. by a linear movement prediction). In the subsequent filter step, the available position estimations are updated or corrected by means of the measured camera data (i.e. on the basis of the recorded image data). For this purpose, a Kalman filter can be used. Also several prediction- or filter steps can follow in succession.

At the same time, parameters of movement equations can be estimated in the tracking phase, the movement equations being able to describe a movement model for the movement of an individual object. In this way, by means of the recorded, i.e. optically detected information (i.e. the movement path of the individual recorded location positions or, provided also the situation is detected, of the movement- and orientation change path which results from the object poses recorded at the several different times), the future movement path of the observed object can be estimated with great precision and hence also the location thereof at the later, potential (provided it concerns a bad object) blow-out time $t_b$. Examples of parameters of the movement equations which can be estimated on the basis of the image sequences are acceleration values in all spatial directions, axes of rotation and directions of rotation. These parameters can be detected by the tracking in the image sequences and establish a movement model for each particle which comprises e.g. also rotation- and transverse movements.

In the prediction phase (during which the observed object, after it has just left the imaging region of the camera 3, moves away out of the region 3' and in the region 3" between this region 3', on the one hand, and the blow-out region 4', on the other hand, and hence can no longer be detected by the camera 3), said prediction phase following the tracking phase (in which the observed object is situated in the image-detection region of the camera 3, i.e. in the region 3'), the determined movement equations can be used in order to predict, for the just observed object (i.e. with corresponding computer output for each detected object in the material flow M), an estimation or calculation of the subsequent location position (or also the pose).

After the object to be tracked has left the field of vision 3' of the camera 3, the prediction phase hence follows. This second phase of the object tracking can consist of one or more prediction steps which are based on the movement models (e.g. estimated rotational movements) determined previously in the tracking phase. The result of this prediction phase is an estimation of the location at a later time (such as for example of the blow-out time $t_b$ and of the location at this time, i.e. of the blow-out position $x_b(t_b)$). Tracking the objects is therefore effected in two phases. The tracking phase is composed of sequences of filter- and prediction steps. Filter steps relate to the processing of camera images in order to improve the current position estimations, and prediction steps extrapolate the position estimations until the next camera image, i.e. next filter step. The prediction phase following the tracking phase consists only of prediction steps since, because of a lack of camera data, a filter step can no longer be implemented.

The tracking phase can be implemented in various ways: either non-recursively, the current object positions or objects situations being determined from each image (no movement models need hereby be used). All the object positions obtained over time can be assembled in order to determine therefrom trajectories for the individual objects. Also recursive processing is possible so that only the current position estimation of an object need be provided. The movement models are hereby used (prediction steps) in order to predict the object movement between camera measurements and hence to relate various filter steps. In one filter step, the prediction of the results of the preceding filter step serves as prior knowledge. In this case, weighting between the predicted positions and the positions determined from the current camera image takes place. Also, it is possible to operate recursively with an adaptation of the movement models: simultaneous estimation of object positions or -situations and model parameters is hereby effected. By observing image sequences, e.g. acceleration values can be determined as model parameters. The movement models are hence identified only during the tracking phase. This can thereby concern a set model for all the objects or individual movement models.

The reference number 1' denotes the extrapolation of the movement path 1, determined in the tracking phase, of an object beyond the detection period of this object by the camera 3, i.e. the predicted movement path of the object after leaving the detection region of the camera 3', i.e. in particular even at the time of the trajectory past the blow-out unit 4 (or through the detection region 4' of the same).

The prediction phase can use directly the model information determined previously in the tracking phase and consists purely of prediction steps, since camera data are no longer available and hence filter steps can no longer be effected. The prediction phase can be further sub-divided, for example into a phase in which the objects are still situated on the conveyor belt and a trajectory phase after leaving the belt. For prediction of the movements, two different movement models can be used in both phases (for example a two-dimensional movement model on the conveyor belt and a three-dimensional movement model in the subsequent trajectory phase).

One possibility for preparing the camera image data for the object tracking resides in converting the data by image pre-processing methods and segmentation methods into a quantity of object positions. Useable image pre-processing methods and segmentation methods are for example non-homogeneous point operations for removing lighting inhomogeneities and region-oriented segmentation methods, such as are described in the literature (B. Jähne, Digitale Bildverarbeitung und Bildgewinnung (Digital Image Processing and Image Production), $7^{th}$ revised edition 2012, Springer, 2012; or J. Beyerer, F. P. León, and C. Frese "Automatische Sichtprüfung: Grundlagen, Methoden und Praxis der Bildgewinnung und Bildauswertung" (Automatic Visual Inspection: Bases, Methods and Practice of Image Production and Image Evaluation), 2013$^{th}$ ed. Springer, 2012).

The assignment of measurements to prior estimations can be effected adapted to the computing capacities available in the computer system 6, for example explicitly by a next-neighbour search or also implicitly by association-free methods. Corresponding methods are described for example in R. P. S. Mahler "Statistical Multisource-Multitarget Information Fusion", Boston, Mass.: Artech House, 2007.

For simultaneous estimation of object positions and model parameters, for example Kalman filter methods or other methods for (non-linear) filtering and state estimation can be used, as are described for example in F. Sawo, V. Klumpp, U. D. Hanebeck, "Simultaneous State and Parameter Estimation of Distributed-Parameter Physical Systems based on Sliced Gaussian Mixture Filter", Proceedings of the 11th International Conference on Information Fusion (Fusion 2008), 2008.

Determination of movement model parameters hereby has two functions:

1. Firstly these parameters are used both in the tracking- and in the prediction phase for calculation of the prediction step(s) in order to enable precise prediction of blow-out time and -position (for example, during the tracking phase, the position of an object predicted by the model can be compared with the object position actually measured in this phase and the parameters of the model can be adapted if necessary).
2. Furthermore, the model parameters extend the feature space, on the basis of which the classification and the subsequent actuation of the blow-out unit can be effected. In particular, bulk materials can consequently be classified and correspondingly sorted, in addition to the optically recognisable features, by means of differences in the movement behaviour.

As an alternative to the construction shown in FIG. 1, also the construction illustrated in FIG. 5 can for example be used, which construction is very similar to that shown in FIG. 1 so that only the differences are described here. In FIG. 5, instead of an individual surface camera 3, a plurality of individual line cameras is used which is disposed along the conveyor belt 2 and above the same (line orientation perpendicular to the transport direction x and to the perpendicular direction z of the cameras 3*a* to 3*c* on the plane of the conveyor belt xy, i.e. in y direction). The z direction corresponds here to the recording direction of the camera 3 (FIG. 1) or of the plurality of cameras 3*a* to 3*c* (FIG. 5). As FIG. 5 shows, also a plurality of line cameras which are spatially offset along the conveyor belt 2 relative to each other at preferably constant spacings (or also a plurality of surface cameras with one or more regions-of-interest, ROIs) including the lightings 5 assigned respectively to the cameras can hence be used. The line cameras or the surface cameras can thereby be fitted both above the conveyor belt 2 and above the trajectory of the bulk material in front of a problem-adapted background 7 (in the illustrated example, this applies to the last camera 3*c* seen in the transport direction x of the belt 2). The consequently achieved image production is illustrated in FIG. 6, in contrast to FIG. 5 (which shows merely three line cameras 3*a* to 3*c*) here for in total six different line cameras disposed in succession along the transport direction x (the detection regions of which are designated with 3*a*' to 3*f*). By using a plurality of line cameras 3*a* to 3*c* (FIG. 5) or 3*a* to 3*f* (FIG. 6) and methods for multiobject tracking, the position of one and the same object can be determined at several times during crossing of the line camera fields of vision 3*a*' to 3*f*', as a result of which a movement path 1 can be obtained in the manner previously described.

Relative to the state of the art, the present invention has a series of essential advantages.

By determining the movement path 1 of each object O1, O2, . . . , a significantly improved prediction or estimation (calculation) of the blow-out time $t_b$ and of the blow-out position $x_b(t_b)$ is possible, even if the constant linear movement assumption of the bulk material is not fulfilled by the speed $v_{belt}$. Consequently, the mechanical complexity for the material settling of uncooperative bulk materials can be significantly reduced.

For extremely uncooperative materials, such as for example spherical bulk material, it is in fact even possible, for the first time in many cases, to implement optical sorting of the described type by means of the present invention.

Against the background that end users, in particular in the food sphere, have a large number of different bulk material products M sorted on one and the same sorting plant, a wide product spectrum can be processed without the need for adaptation, by means of conveyor belt change (for example use of conveyor belts with a surface which is structured to different thicknesses) or other mechanical changes, to uncooperative bulk material.

In addition, the method for multiobject tracking enables improved optical characterisation and feature production from the image data of the individual objects O of the observed bulk material flow M. Since the uncooperative objects are presented generally in different three-dimensional situations to the camera, because of their additional intrinsic movement, image features of different object views relating to an expanded object feature can be accumulated over the individual observation times. For example, also the three-dimensional shape of an object can consequently be estimated and used as a feature for sorting. Extrapolation of the three-dimensional shape of an object from the recorded image data can thereby be effected, as described in the literature (see e.g. S. J. D. Prince "Computer vision models, learning, and inference", New York, Cambridge University Press, 2012), e.g. by means of the visual outline of the individual objects in different poses (Shape-from-Silhouettes method).

As a result, improved differentiation of objects with orientation-dependent appearance is achieved. In many cases, a further camera for a two-sided examination can consequently be dispensed with. The expanded object features can in addition also be used for improved movement modelling within the scope of the predictive tracking by, for example, the three-dimensional shape being taken into account for prediction of the trajectory.

Furthermore, the identified model, which characterises the movement path 1 of a specific object, can itself be used as feature for a classification- or sorting decision. The movement path 1 determined by means of the individual camera recordings and also that after leaving the scanning region 3', i.e. the future movement path 1' estimated on the basis of the movement path 1, are influenced by the geometric properties and also the weight of the object and consequently offer a conclusion option with respect to the association to a bulk material fraction.

The evaluation of the additional uncertainty descriptions for the estimated blow-out time and the blow-out position provides a further technical advantage for the bulk material sorting. This enables adapted actuation of the pneumatic blow-out unit for each object to be ejected. If the estimated values are associated with great uncertainty, a larger blow-out window can be chosen in order to ensure ejection of a bad object. Conversely, the dimension of the blow-out window and hence the number of actuated nozzles can be scaled down in the case of estimations with low uncertainty. As a result, the consumption of compressed air can be reduced during the sorting process, as a result of which costs and energy can be saved.

As a result of the multiple position determination of objects of the bulk material flow at different times and also the evaluation of an image sequence instead of a momentary image recording (this can also concern multiple measurement, calculation and accumulation of object features at different times and also use of identified movement models as feature for an object classification), in general a significantly improved separation is achieved during automatic sorting of any bulk materials. In addition, compared with the state of the art for sorting uncooperative materials, the mechanical complexity for material settling can be significantly reduced.

Furthermore, the present invention can be used for sorting bulk materials of a complex shape which must be examined from several different viewpoints, only one individual surface camera at a fixed position being used.

By using an identified movement model as differentiation feature, in addition bulk materials with the same appearance but object-specific movement behaviour (e.g. due to different masses or surface structures) can be classified and sorted automatically.

The invention claimed is:

1. A conveying system for transporting a material flow (M) comprising a large number of individual objects (O1, O2, . . . ), wherein with the conveying system, by means of optical detection of individual objects (O1, O2, . . . ) in the material flow (M), for these objects (O1, O2, . . . ) respectively the location position (x(t),y(t)) thereof at several different, fixed times ($t_{-4}$, $t_{-3}$, . . . ) can be determined and by means of the location positions (x(t),y(t)) determined at the different, fixed times ($t_{-4}$, $t_{-3}$, . . . ), for these objects (O1, O2, . . . ) respectively the location ($x_b(t_b)$, $y_b(t_b)$) thereof at the at least one defined time ($t_b$) after the respectively latest of the different, fixed times ($t_{-4}$, $t_{-3}$, . . . ) can be calculated.

2. The conveying system according to claim 1, wherein the movement paths (1) composed of a plurality of location positions (x(t),y(t)) of the respective object at different times ($t_{-4}$, $t_{-3}$, . . . ) can be determined for the individual objects (O1, O2, . . . ), the movement paths of different objects (O1, O2, . . . ) being able to be determined and/or being able to be differentiated from each other via recursive or non-recursive estimating methods.

3. The conveying system according to claim 1, wherein a movement model can be determined respectively for the objects (O1, O2, . . . ) by means of the respective movement paths thereof, in particular can be selected from a prescribed quantity of movement models, and/or parameters for such a movement model can be determined.

4. The conveying system according to claim 1, wherein the individual objects (O1, O2, . . . ) can be classified on the basis of the optical detection.

5. The conveying system according to claim 1, wherein the classification of an object (O1, O2, . . . ) can be performed by taking into account the location positions (x(t),y(t)) determined for this object at the different, fixed times ($t_{-4}$, $t_{-3}$, . . . ), the movement path determined for this object and/or the movement model determined for this object.

6. The conveying system according to claim 1, wherein the two-dimensional location positions (x(t),y(t)), in particular two-dimensional location positions relative to the conveying system, can be determined for the objects (O1, O2, . . . ), or in that three-dimensional location positions in space can be determined for the objects (O1, O2, . . . ).

7. The conveying system according to claim 1, wherein with the conveying system, by means of optical detection of the individual objects (O1, O2, . . . ) in the material flow (M), for these objects (O1, O2, . . . ) respectively in addition to the location position (x(t),y(t)) thereof, also the orientation thereof at several different times ($t_{-4}$, $t_{-3}$, . . . ) can be determined and in that, by means of the location positions (x(t),y(t)) and orientations determined at the different times ($t_{-4}$, $t_{-3}$, . . . ) for these objects (O1, O2, . . . ), respectively the location ($x_b(t_b)$,$y_b(t_b)$) thereof at the at least one defined time ($t_b$) after the respectively latest of the different times ($t_{-4}$, $t_{-3}$, . . . ) can be calculated.

8. The conveying system according to claim 1, wherein by means of the location positions (x(t),y(t)) and orientations determined at the different times ($t_{-4}$, $t_{-3}$, . . . ) for these objects (O1, O2, . . . ), respectively in addition to the location ($x_b(t_b)$,$y_b(t_b)$) thereof also the orientation thereof at the at least one defined time ($t_b$) after the respectively latest of the different times ($t_{-4}$, $t_{-3}$, . . . ) can be calculated.

9. The conveying system according to claim 1, wherein the optical detection is effected by means of one or more optical detection unit(s), which comprises/comprise or preferably is/are one or more surface sensor(s) and/or a plurality of line sensors at a spacing from each other, and/or in that, during the optical detection, a sequence of two-dimensional images can be recorded, from which the location positions of the objects at the different times can be determined.

10. The conveying system according to claim 1, wherein within the scope of the optical detection of one or more of the objects (O1, O2, . . . ) at several different times ($t_{-4}$, $t_{-3}$, . . . ), images, in particular camera images, of this/these object/s can be produced, in that respectively the shape(s) of this/these object/s in the produced images can be determined and in that respectively a three-dimensional image of this/these objects/s can be calculated from the determined shapes.

11. The conveying system according to claim 1, wherein the calculation of the location(s) of the object/s at the defined time(s) is effected taking into account calculated three-dimensional image/s.

12. The conveying system according to claim 1, wherein classification of the object/s is effected using the calculated three-dimensional image/s.

13. A plant for bulk material sorting comprising a conveying system according to claim 1, wherein a sorting unit with which the objects (O1, O2, . . . ) can be sorted on the basis of the calculated locations ($x_b(t_b)$,$y_b(t_b)$) at the defined time(s) ($t_b$).

14. A plant according to claim 1, wherein the objects can be sorted on the basis of the classification thereof, the classification being effected into good objects (GO1, GO2, . . . ) and into bad objects (SO1, SO2) and preferably the sorting unit having an ejection unit, in particular a blow-out unit, which is configured to remove bad objects from the material flow (M) using the calculated locations $(x_b(t_b),y_b(t_b))$ at the defined time(s) $(t_b)$.

15. A method for transporting a material flow (M) comprising a large number of individual objects (O1, O2, . . . ), wherein in this method, by means of optical detection of individual objects (O1, O2, . . . ) in the material flow (M), for these objects (O1, O2, . . . ) respectively the location position (x(t),y(t)) thereof at several different, fixed times $(t_{-4}, t_{-3}, \ldots)$ is determined, and in that, by means of the location positions (x(t),y(t)) determined at the different, fixed times $(t_{-4}, t_{-3}, \ldots)$, for these objects (O1, O2, . . . ) respectively the location $(x_b(t_b),y_b(t_b))$ thereof at at least one defined time $(t_b)$ after the respectively latest of the different, fixed times $(t_{-4}, t_{-3}, \ldots)$ is calculated, the method being implemented using a conveying system or a plant according to claim 1.

* * * * *